US005413050A

United States Patent [19]

Maki

[11] Patent Number: 5,413,050

[45] Date of Patent: May 9, 1995

[54] PATTERN CONTROLLER USED WITH SHOTSHELL

[76] Inventor: Nagatoshi Maki, 2-48-4, Kamiishihara, Chofu-shi, Tokyo, Japan

[21] Appl. No.: 108,318

[22] Filed: Aug. 18, 1993

[51] Int. Cl.[6] ..... F42B 7/00

[52] U.S. Cl. ..... 102/457; 102/449

[58] Field of Search ..... 102/448–463, 102/532

[56] References Cited

U.S. PATENT DOCUMENTS

| | | | |
|---|---|---|---|
| 579,429 | 3/1897 | Elliott | 102/457 |
| 1,864,916 | 6/1932 | Gachassin-Lafite . | |
| 1,941,336 | 12/1933 | Barbieri | 102/457 |
| 3,074,344 | 1/1963 | Devaux . | |
| 3,565,010 | 2/1971 | Sahlmann | 102/532 |
| 3,750,579 | 8/1973 | Bellington | 102/451 |
| 3,812,784 | 5/1974 | Herter | 102/532 |
| 4,151,799 | 5/1979 | Jackson | 102/532 |
| 4,167,904 | 9/1979 | Ferri | 102/450 |
| 4,452,144 | 6/1984 | Maki . | |
| 4,506,605 | 3/1985 | Maki | 102/457 |
| 4,635,555 | 1/1987 | Ferri | 102/453 |
| 4,669,385 | 6/1987 | Maki . | |
| 4,676,169 | 6/1987 | Maki . | |
| 5,299,502 | 4/1994 | Maki | 102/457 |

FOREIGN PATENT DOCUMENTS

| | | | |
|---|---|---|---|
| 159390 | 10/1985 | European Pat. Off. | 102/457 |
| 1474070 | 3/1967 | France | 102/449 |
| 92430 | 11/1968 | France | 102/532 |
| 2063728 | 7/1971 | France | 102/532 |
| 2247697 | 5/1975 | France | 102/462 |
| 20110488 | 6/1983 | Germany . | |
| 645353 | 9/1962 | Italy | 102/449 |
| 896 | of 1878 | United Kingdom . | |
| 715920 | 2/1980 | U.S.S.R. . | |

OTHER PUBLICATIONS

Co-pending application Ser. No. 07/943,109, filed Sep. 10, 1993 (pending), by Nagatoshi Maki, which is a divisional Ser. No. 07/694,135, filed May 1, 1991 (abandoned), by Nagatoshi Maki.

*Primary Examiner*—Harold J. Tudor

*Attorney, Agent, or Firm*—Merchant, Gould, Smith, Edell, Welter & Schmidt

[57] ABSTRACT

A pattern controller has a disc-like adjuster which can be snugly fitted in a case and a plurality of stays which integrally project in the axial direction from the adjuster. The adjuster is provided with a tapered surface adjacent to the stays to define a guide surface for shot and a center hole through which shot passes. The stays are inserted in the shot charged in the case, so that the adjuster surrounds the shot. The case is crimped to complete a shotshell. The pattern controller provides a concentrated-type shotshell or a scatter-type shotshell. When the shotshell is fired from a skeet choked barrel or an improved cylinder barrel, a remarkably concentrated or scattered pattern can be obtained. A ultra scattering type of pattern controller which has no center hole is also disclosed.

5 Claims, 8 Drawing Sheets

PATTERN CONTROLLER USED WITH SHOTSHELL

BACKGROUND OF THE INVENTION

1. Field of the Invention

The present invention relates to a pattern controller of a shotshell which controls the shot pattern of a shotshell.

2. Description of Related Art

In a conventional shotgun, the barrel thereof is usually provided therein with a choke to control the distribution density (pattern) of a shotpellets at a predetermined shooting range. A full-choke barrel which is provided, in the vicinity of the muzzle, with a great degree of choke to concentrate the shotpellets can be advantageously used for a long-range shooting, such as a trap shooting. On the other hand, a barrel having a negative choke, i.e., a skeet choke in which the muzzle is slightly enlarged to scatter the shotpellets, is usually used for a short-range shooting, such as skeet shooting.

There are intermediate several degrees of choke, including an improved cylinder barrel, a recess choked barrel or a true cylinder barrel (which has no choke because the choked portion has disappeared because of cutting away the choked front end portion of the barrel to shorten the length of the barrel). For instance, the improved cylinder barrel which is provided with a small amount of choke (a little choke) put therein is widely used by many hunters.

Note that the improved cylinder barrel, the recess choked barrel, and the true cylinder barrel will be generally referred to as a cylinder bore barrel hereinafter.

As can be understood from the foregoing, in the prior art, a remarkable function to concentrate or scatter shotpellets to be fired from a muzzle has mainly relied on the choke of the barrel, with a few exceptions.

The primary object of the present invention is to provide a pattern controller which can be loaded in a shotshell to realize a more extremely concentrated or scattered pattern than conventional commercially available shotshells even if the shotshell having the pattern controller incorporated therein is fired from a skeet choke or a cylinder bore barrel.

SUMMARY OF THE INVENTION

To achieve the object mentioned above, according to the present invention, in a shotshell including a case which is comprised of a base metal and a cylindrical hull connected thereto and defining a cylindrical bore, and a primer, said case being provided therein with gun powder (propellent), a wad, and shotpellets successively charged therein in this order, the improvement comprising a pattern controller which comprises an adjuster and a support coaxial thereto and integral therewith, said adjuster having a circular body with a circular periphery whose diameter is such that the circular body can be snugly fitted in the cylindrical hull of the case, said circular body being generated by revolving a predetermined shape about an axis of the pattern controller, said support being provided with a plurality of stays which integrally project from the adjuster in parallel with the center axis of the circular body, said stays being located substantially at an equidistance from the center axis of the circular body in a symmetrical arrangement with respect to the center axis of the circular body, said adjuster of the pattern controller being located closer to the crimped end of the case than the stays when the pattern controller is loaded in the case. Preferably, the stays are made of projections integral with the adjuster and extending in a direction perpendicular to a plane in which the adjuster lies.

In one embodiment, the projections are separate from one another and located at an equiangular distance in a symmetrical arrangement with respect to the center axis of the circular body.

In another embodiment, the projections are made of a single piece which is provided with a plurality of radially extending plates.

BRIEF DESCRIPTION OF THE DRAWINGS

The invention will be described below in detail with reference to the accompanying drawings, in which.

DESCRIPTION OF THE PREFERRED EMBODIMENT

Figure 3:
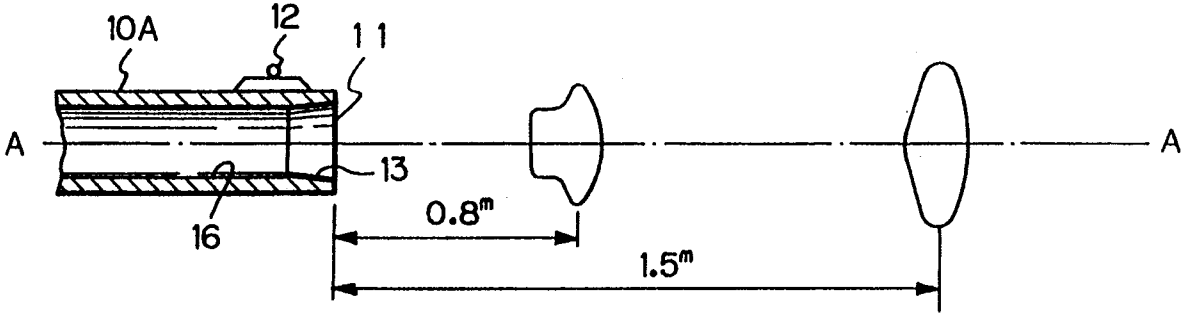
Fig. 3 PRIOR ART
FIG. 3 is an explanatory sectional view of a known skeet choked barrel and shapes of hot columns (shotpellets are not shown) fired therefrom.
Figure 4:
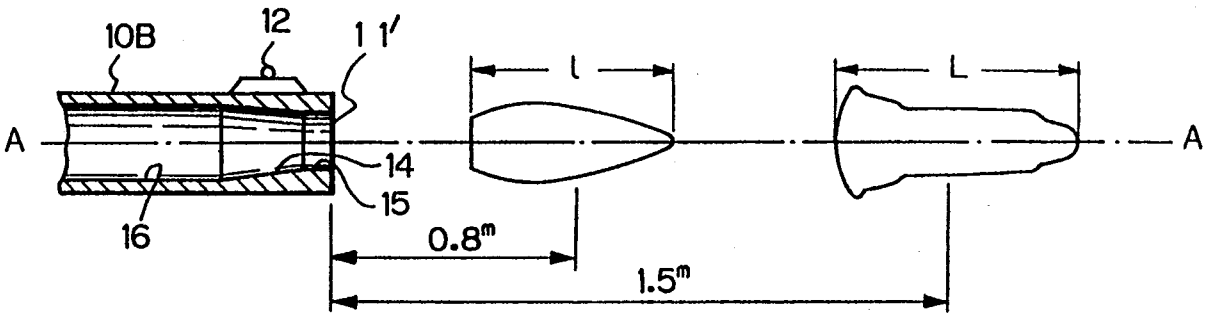
Fig. 4 PRIOR ART
FIG. 4 is an explanatory sectional view of a known full-choked barrel and shapes of shot columns (shotpellets are not shown) fired therefrom.
Figure 11:
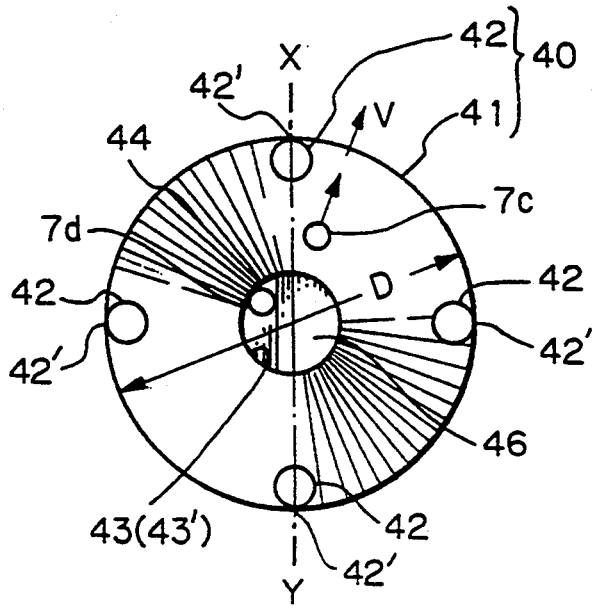
FIG. 11 is a rear end view of the pattern controller shown in FIG. 10.

FIGS. 3 and 4 show partial sectional views of a skeet choked barrel having a skeet choked portion 13 and a full choked barrel having a cone (tapered portion) 14 and a parallel (circular cylindrical portion) 15, respectively. In FIGS. 3 and 4, 11 and 11' designate the muzzle, 12 the front sight, and 16 the inner surface of the barrel, respectively.

Figure 1:
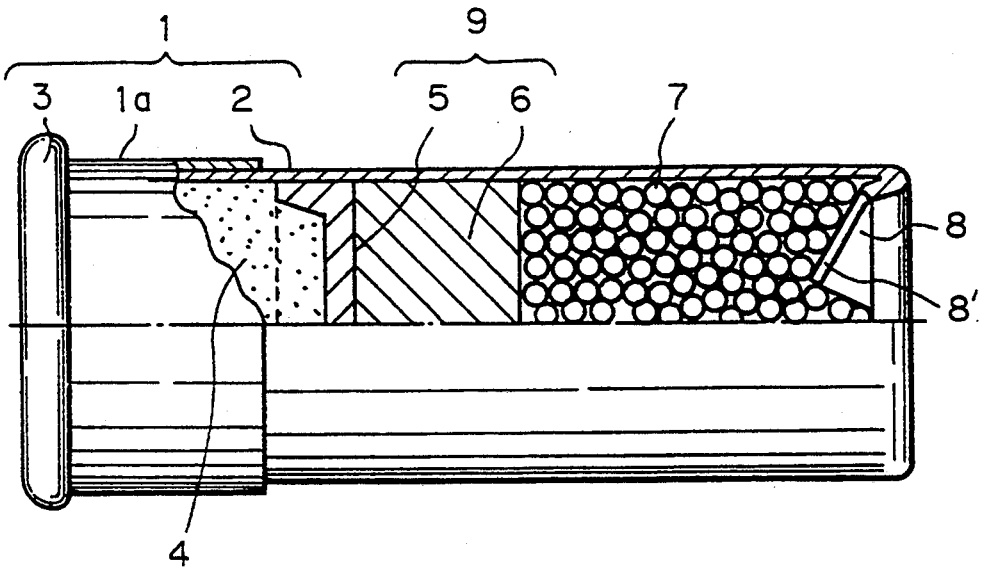
Fig. 1 PRIOR ART
FIG. 1 is a partially sectioned conceptual view of a conventional shotshell.
Figure 2:
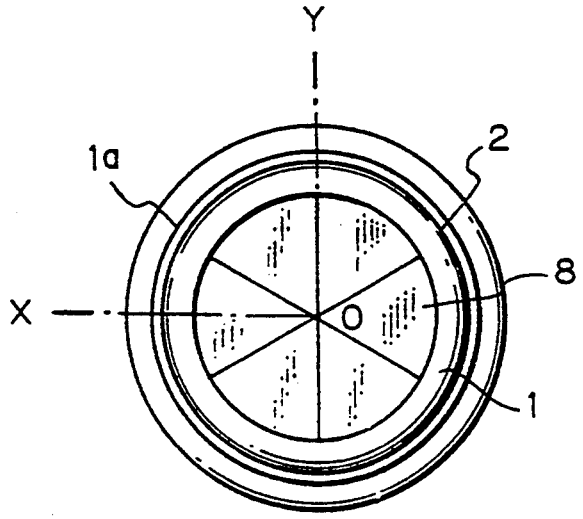
Fig. 2 PRIOR ART
FIG. 2 is a front end view of FIG. 1.

FIGS. 1 and 2 show conceptual views of a conventional shotshell which includes a case 1 having a metal head 1*a*, a primer 3 fitted at the rear end of the case 1, and a cylindrical hull 2. A powder charge 4, a wad 9 having a sealing member 5 and a cushion 6, and shotpellets 7 are arranged in the case 1 in this order. The case 1 is provided, at the front end thereof, with a pie-shaped crimp 8 which is formed by folding and curling the front end of the case 1 inwardly at a plurality of folds (e.g., 6 or 8 folds).

To understand structure and operation of a pattern controller of the present invention in comparison with a conventional shotshell, the following discussion will be first directed to a shot column fired from a muzzle 11 or 11', which shot column varies through time.

A. Shot Column Fired from a Skeet Choked Barrel 11 (FIG. 3):

A-1) A group of shotpellets (shotpellet group) 7 is tightly crowded, by the wad 6 due to the pressure which is produced when the powder 4 burns, so that when the shotpellet group 7 reaches the muzzle 11, the shotpellet group 7 which has been substantially cylindrical is shortened.

Figure 5:
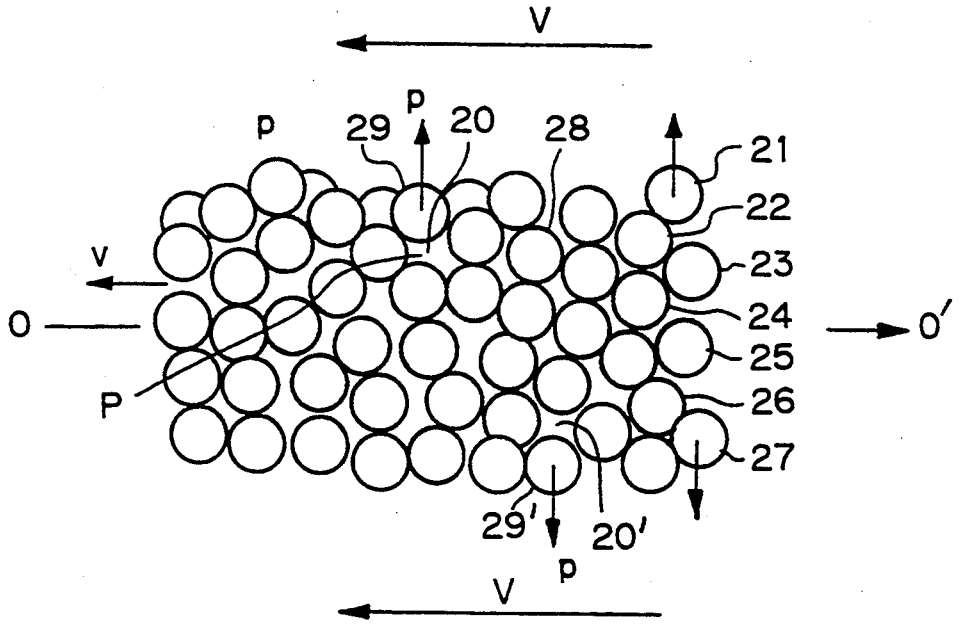
Fig. 5 PRIOR ART
FIG. 5 is a conceptual view of a known shot column immediately after being expelled from a muzzle.

Since the skeet choke 13 increases in diameter towards the muzzle 11, no increase in resistance by the skeet choke 13 takes place at the time the shot column leaves the muzzle. Consequently, the shot column immediately after being expelled from the muzzle 11 is maintained substantially cylindrical, as shown in FIG. 5 in which the shot column is expelled in the direction O→O' (from left to right in FIG. 5). The axis O—O' designates the line of sight.

The speed of the shot at the moment of expulsion is higher than the velocity of sound, and accordingly, the exposed foremost pellets (the first group of pellets) 21, 23, 25 and 27 of the shot column directly receive a strong total pressure (sum of dynamic pressure and static pressure) from the relative wind. Consequently, these exposed foremost pellets are braked and decelerated. As is well known, the spherical shotpellets which are mainly made of lead and which have a large mass have an extremely large kinetic energy during flight.

The second group of shotpellets 22, 24 and 26 located behind the first group of pellets 21, 23, 25 and 27 mentioned above tend to maintain a constant speed due to not only the inertia thereof but also the extremely greater inertia of the large number of shotpellets located behind the second group of shotpellets than the first-mentioned inertia. Consequently, the second group of pellets 22, 24 and 26 are forced between the shotpellets of the first group, while pushing the latter aside. As a result, for example, the outermost shotpellets 21 and 27 of the first group are moved outwardly in the radial direction, as shown by arrows in FIG. 5. This is the beginning of scattering.

The above mentioned phenomena repeatedly occurs among the remaining shotpellets. Namely, for example, the shotpellet 28 is forced between the two shotpellets located in front thereof. Consequently, the shot column assumes a generally mushroom shape having an expanded front end, as shown at S in FIG. 3.

A-2) Even in a dense shot column, spaces between the adjacent spherical shotpellets are interconnected.

Namely, there are many air passages between the front end and rear end of the shot column, so that the relative wind partly flows from the front end to the rear end through the air passages. However, the speed of the air flow is reduced by flow resistance when the air passes through the complex and random arrangement or pattern of air passages.

Consequently, the speed V of the air flow passing outside the shot column is larger than the speed v of the air flow passing through the shot column, so that the pressure P of the gap (e.g., 20 or 20') between the shotpellets is higher than the outside pressure p of the shot column, as shown in FIG. 5.

The pressure difference (P-p) causes the shotpellets (e.g., 29 and 29') to be moved outward in the radial directions, as shown by arrows, and thus promotes the scattering of the shotpellets, in addition to the scattering operation discussed above in A-1).

The mushroom-shaped shot column S shown in FIG. 3 is at a distance of 0.8 m from the muzzle 11. The shot column is then deformed into a substantially circular disc shape S' at a distance of 1.5 m from the muzzle. Thereafter, the diameter of the disc-shaped shot column is suddenly increased, and the axial length (thickness of the disc) of the shot column is also increased due to the difference in resistance to the wind pressure among the shotpellets, etc. Consequently, the shot column thus wholly expanded exhibits a large diameter pattern which covers a wide range of distribution, particularly suitable for a short range shooting, such as a skeet shooting.

B. Shot Column Fired from Full-Choke Barrel 11'(FIG. 4):

In a full-choke barrel, the shot column is forcedly deformed into an elongated shape when the shot column passes the portion of the barrel having a decreased diameter, i.e., the cone section 14 and the cylindrical section 15. Since the deformation takes place suddenly, the density or concentration of the shotpellets in the shot column fired from the muzzle 11' is reduced or thinned. This is as if crowded people crushed into a small entrance advance in a thin line after they pass the entrance.

Consequently, there are increased distances between the shotpellets, and accordingly, it rarely happens that the shotpellets are forced between the shotpellets located in front thereof unlike A-1) mentioned above. This results in an acorn-shaped or chinquapin-shaped shot column T (FIG. 4) at a distance of 0.8 m from the muzzle 11', which is completely different from the mushroom-shaped shot column S shown in FIG. 3. Furthermore, since the rear shotpellets in the rear part of the shot column do not directly receive the wind pressure of the relative wind which is intercepted by the shotpellets located in front of the rear shotpellets within the rear part of the shot column, the rear shotpellets tend to fly at a constant speed and catch up with the shotpellets in front thereof within the rear part of the shot column to be forced therebetween due to inertia, as discussed in item A-1) mentioned above. Consequently, the outer shotpellets in the rear part of the shot column are scattered outward in the radial directions, as shown at T' in FIG. 4. The shot column T' is at a distance of 1.5 m from the muzzle 11'. The scattering successively and continuously occurs in the remaining part of the shot column towards the front end thereof. Thus, the shot column flies while increasing the diameter and axial length thereof. This is the commencement of a substantial expansion of the shot column.

It should, however, be appreciated that the expansion of the shot column in FIG. 4 commences later and occurs more slowly than that in FIG. 3, and accordingly, the shot column fired from the full-choked barrel has a more concentrated pattern than the shot column fired from the skeet-choked barrel at a same range. This is the reason that the full-choked barrel has been advantageously and suitably used for a long-range shooting. Note that the shapes of the shot columns discussed above and shown in FIGS. 3 and 4 are similar to known photographs, taken by an ultra-high-speed camera.

Figure 6:
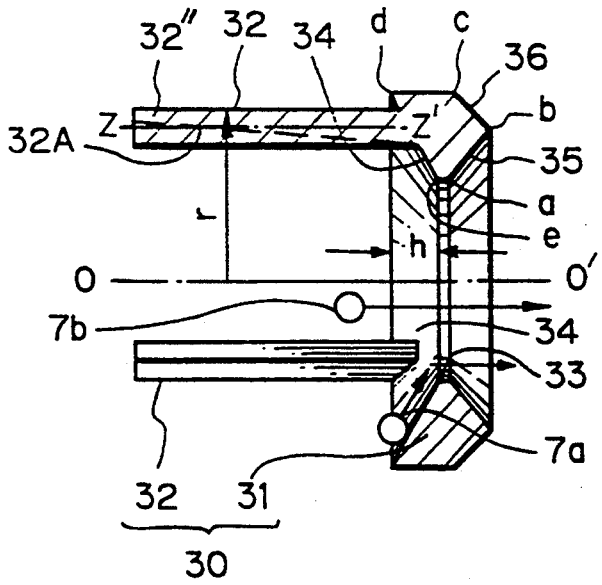
FIG. 6 is a side view of a pattern controller sectioned along a center axis X-Y shown in FIG. 7, according to a first embodiment of the present invention.
Figure 7:
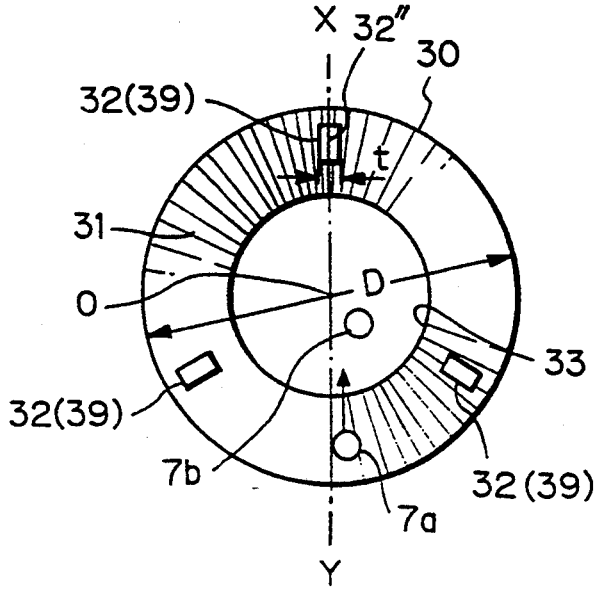
FIG. 7 is a rear end view of FIG. 6.
Figure 8:
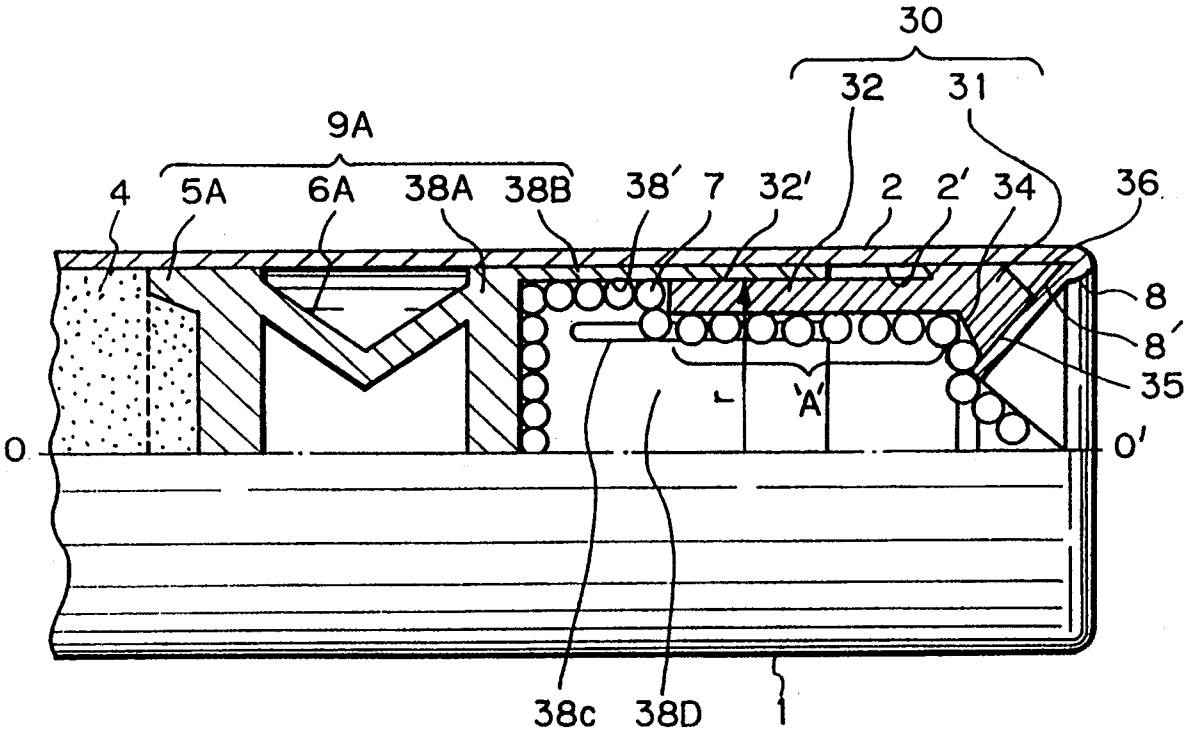
FIG. 8 is a partial sectional view of the main components of a shotshell having a pattern controller incorporated therein and shown in FIGS. 6 and 7.

FIGS. 6, 7 and 8 show a concentrating type pattern controller 30 according to a first embodiment of the present invention.

The pattern controller 30 shown in FIGS. 6, 7 and 8 can be advantageously used with a shotshell of a concentrated pattern. The pattern controller 30 is made of a material having the necessary strength and elasticity, such as a plastic.

FIG. 6 is a sectional view of the pattern controller 30 taken along the axis X-Y in FIG. 7, and FIG. 7 is a rear end (left side) view of FIG. 6.

The pattern controller 30 is comprised of an adjuster 31 and a support 39 coaxial thereto and integral therewith. The latter includes a plurality of (e.g., three) independent stays 32, as can be seen in FIG. 6. The adjuster 31 is substantially in the form of an annular disc having a uniform cross sectional shape defined by a closed contour connecting five predetermined points a, b, c, d, e (a,b,c, d, e, a). Namely, the adjuster (annular disc) 31 is made of a solid which can be conceived as generated by the revolution of the uniform cross sectional shape about the axis O—O'.

The adjuster 31 has a truncated conical guide face (rear face) 34 whose diameter decreases towards the front (right in FIG. 6) end thereof, defined by the locus of a straight line connecting the points d and e as revolved about the axis O—O'. The adjuster 31 also has truncated conical front faces 35 and 36. The front faces 35 and 36 are defined by the loci of straight lines connecting the points a and b and the points b and c as revolved about the axis O—O', respectively.

The adjuster 31 is provided with a center axial through hole 33 defined by the locus of a straight line connecting the points e and a as revolved about the axis O—O'.

The outer diameter D of the adjuster 31 is substantially equal to the inner diameter of an inner peripheral surface 2' of the cylindrical hull 2 of the associated case 1 having a corresponding gauge, so that the adjuster 31 can be snugly fitted in the cylindrical hull 2. Each of the stays 32 is made of a rectangular plate extending perpendicularly to the plane of the adjuster 31. The stays 32 project from the guide face 34 of the adjuster 31 integral with the stays 32 in a symmetrical arrangement with respect to the axis O—O', so that the center axis Z—Z' of each stay 32 shown in FIG. 6 and the axis O—O' of the adjuster 31 lie in one imaginary plane. Note that the axis Z—Z' is defined by a continuous line passing through the middle of each stay 32 in the longitudinal direction of the adjuster, in a median section 32" (FIG. 6) of the stay sectioned by an imaginary plane including the axis O—O' of the adjuster 31. The shape of the stays 32 is not limited to a rectangle, as shown in the illustrated embodiment, but can be optional. For example, the stays 32 can be of a wedge-shape with a width decreased towards the free ends (rear ends) thereof, as shown by a phantom line 32A in FIG. 6 or with a thickness t (FIG. 7) decreased towards the free ends (rear ends) thereof.

In FIG. 8, which shows main components of a shotshell having the above-mentioned pattern controller 30 incorporated therein, a wad 9A, as is well known, is integrally provided with a seal member 5A, a cushion 6A, a disc 38A, and a cylinder 38B. The cylinder 38B defines therein a circular cylindrical bore 38D having a front open end. The powder 4, the wad 9A and the shotpellets 7 are loaded in the case 1, in this order. Thereafter, the stays 32 of the pattern controller 30 are inserted and the shotpellets 7 charged in the cylindrical bore 38D of the wad 9A, so that the pattern controller 30 is loaded in the case 1. Thereafter, the opening end of the case 1 is folded and closed to form the crimp 8.

Note that the radius r (FIG. 8) of an imaginary circle defined by the outer peripheral surfaces 32' of the stays 32 is substantially equal to that of the cylindrical inner peripheral surface 38' of the cylinder 38B with which the loaded shotpellets 7 come into contact. Namely, the radius r is equal to a distance between a farthest portion (outer extreme portion) 32' on the outer peripheral surface of each stay 32 from the axis O—O' and the axis O—O' of the support 39, and can be predetermined depending on the thickness of the cylinder 38B.

The alignment of the axis O—O' of the pattern controller 30 with the axis O—O' of the case 1 during loading is achieved as follows.

When the pattern controller 30 is loaded in the case 1, the adjuster 31 whose diameter is D, located adjacent to the open end of the case 1 is supported by the inner peripheral surface 2' of the cylindrical hull 2, and the outer peripheral surfaces 32' of the stays 32 inserted in the shotpellets of the shotshell are supported by the cylindrical inner surface 38' of the cylinder 38 with which the shotpellets come into contact. Namely, the front portion of the pattern controller 30 is supported by the inner peripheral surface 2' of the cylindrical hull 2 and the rear portion of the pattern controller is supported by the cylindrical inner surface 38' of the cylinder 38. Consequently, when the pattern controller 30 is loaded in the case 1, the axis of the pattern controller 30 can be coaxially aligned with the axis of the case 1.

Furthermore, as can be seen in FIG. 8, since the folded terminal end 8' of the crimp 8 is substantially snugly in contact with the front face 35 of the adjuster 31 without a gap therebetween, the crimp 8 ensures a certain enclosure of the shotshell and realizes a good appearance.

The pattern controller 30 constructed above, according to the first embodiment operates as follows.

When the powder 4 burns, the pattern controller 30 is moved forward by the shotpellets 7, so that the crimp 8 is substantially uniformly straightened out by the front faces 35 and 36 of the pattern controller 30. As a result, the shot column which is still within the case 1 and which is covered at the front end thereof by the adjuster 31 and at the outer periphery thereof by the stays 32, respectively is forced into the barrel bore, while keeping the correct posture (alignment with the axis of the case 1) thereof.

As is well known, since the bore of the cylindrical hull 2 of the case 1 is substantially identical to the inner diameter of the barrel bore of the corresponding shotgun, the pattern controller 30 passes the barrel bore and is expelled from the muzzle, while holding the shot column therein. The pattern controller 30 receives the total pressure of the relative wind at the front faces 35 and 36 thereof immediately after expelled from the muzzle, and accordingly, the pattern controller 30 is braked. It should be appreciated that the front face 36 of the pattern controller 30 is aimed at a reduction of a drag coefficient Cd so as to prevent the braking force from becoming too large. The front face 36 can be a curved surface.

Since the shotpellets 7, i.e., a group of shotpellets 'A', located behind the guide face 34 receive no direct relative wind, the pellet group 'A' tends to maintain the same speed due to a large inertia inherent thereto and pushes the shotpellets (one of which is indicated at *7a* in FIG. 6) which come into contact with the guide face 34, in the direction of expelling. Consequently, the shotpellet *7a* which is pushed from behind is moved toward the center, as shown an arrow along the inclined surface of the guide face 34. As a result, the shotpellet *7a* moves forward through the through hole 33 and flies at high speed in the expelling direction while overcoming the wind resistance owing to the large kinetic energy possessed by the shotpellet *7a*. This operation repeatedly takes place among the pellets located behind the guide face 34, so that a large part of the shotpellets behind the guide face 34 passes through the through hole 33 to separate forward from the adjuster 31. In addition thereto, the shotpellet(s), e.g., the shotpellet *7b* located behind the through hole 33 is pushed from behind, similarly to the shotpellet *7a*, so that the shotpellet *7b* is moved forward as indicated at an arrow, and flies in the expelling direction past the through hole 33.

As can be seen from the foregoing, a large number of shotpellets 7 tend to quickly pass the through hole 33 whose diameter is smaller than the diameter D of the adjuster 31, and accordingly, a passage resistance is produced, so that the shot column past the through hole 33 is transformed into an elongated shape having a decreased density.

The change in shape and the operation of the shot column thereafter are similar to those of the shot column expelled from the choked barrel mentioned above in item B, and accordingly, when the shotshell having the concentration type of pattern controller 30 incorporated therein is fired from a skeet barrel or a cylinder bore barrel, the pattern of the shot column at a predetermined range can be extremely concentrated in comparison with the conventional shotshell. Note that the cylinder 38B of the wad *9a* is spread as if petals open or skin of a banana is peeled, when the slits 38C thereof open due to the wind pressure, immediately after being expelled from the muzzle, so that the spread parts of cylinder 38B function as an air brake which causes the wad *9a* to be separate from the pattern controller 30.

The pattern density (pattern percentage) of a concentration type of pattern controller 30 can be optionally and properly designed by setting an optimal inclination angle of the guide face 34 and an optimal diameter of the through hole 33.

Figure 9:
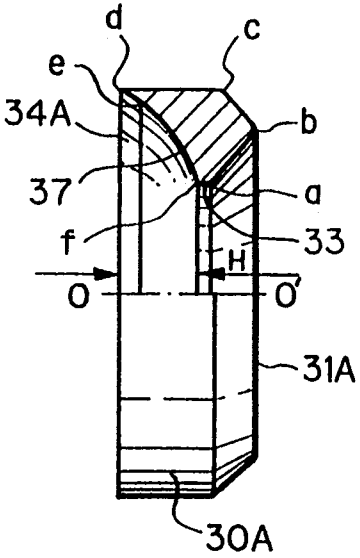
FIG. 9 is a partial sectional view of a modified pattern controller, according to the present invention.

FIG. 9 shows a modified arrangement of the first embodiment mentioned above. In FIG. 9, the stays 32 are omitted only for clarity. The pattern controller 30A is provided with an adjuster 31A having a uniform cross sectional shape which is slightly different from that of the adjuster 31 of the first embodiment. Namely, in FIG. 9, the adjuster 31A is made of a solid which can be conceived as generated by revolving a shape defined by a closed contour defined by straight lines connecting predetermined points f, a, b, c, d, and e, and a curved line connecting the points e and f, about the axis O—O'. Namely, the arrangement shown in FIG. 9 is distinguished from that shown in FIG. 6 by a truncated conical guide face 34A formed by revolving, the straight line connecting the points d and e about the axis O—O', and a curved guide face 37 formed by revolving the curved line connecting the points e and f about the axis O—O', in combination. The depth H of the recess defined by the combined guide surface (34A plus 37) of the adjuster 31A is longer than that h of the adjuster 31 shown in FIG. 6. The other structure and shape of the adjuster 31A are identical to those of the adjuster 31 of the first embodiment.

In the modified embodiment shown in FIG. 9, a component of force which moves the shotpellets (e.g., shotpellet *7a* in FIG. 6) located behind the guide faces 34A and 37, in the axial direction O—O' is increased in comparison with the first embodiment, and accordingly, the resistance which is produced when a large number of shotpellets 7 pass through the through hole 33 is increased, thus resulting in the formation of a more elongated shot column expelled from the muzzle 11. Thus, a more concentrated pattern can be obtained.

Figure 14:
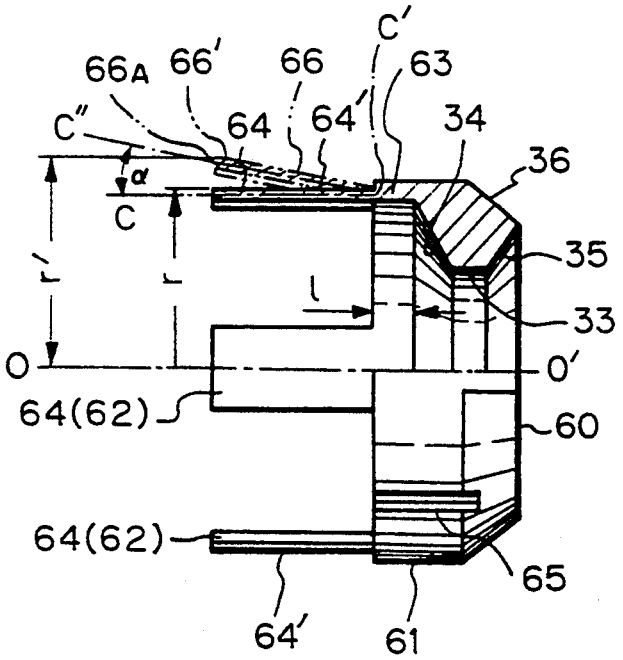
FIG. 14 is a partially sectioned side view of a improved pattern controller, according to the present invention; and, FIG. 15 is a rear end view of FIG. 14.
Figure 15:
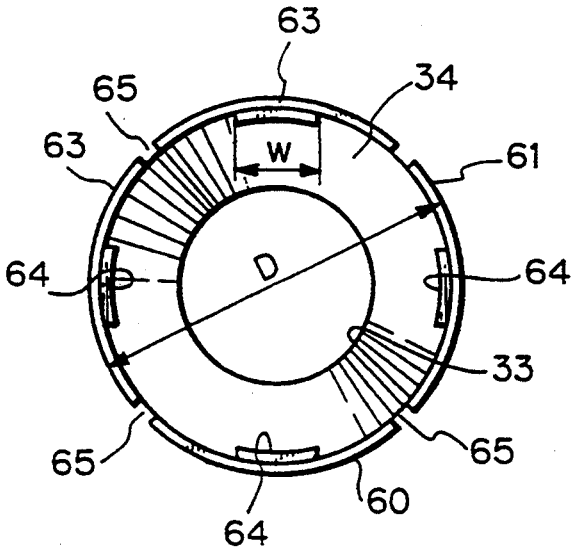

FIGS. 14 and 15 show an improved embodiment of the first embodiment discussed above. The pattern controller 60 in FIGS. 14 and 15 is comprised of an adjuster 61 and a support 62 coaxial thereto and integral therewith. Similarly to the adjuster 31 in the first embodiment, the adjuster 61 whose diameter is D is provided with truncated conical faces 35 and 36, a guide face 34, and a through hole 33.

The guide face 34 is provided with a cylindrical tube 63 integral therewith, whose diameter and axial length are D and l, respectively. The support 62 includes four identical stays 64, each made of a curved plate having an arched section. The stays 64 having the center axes C—C' extend in parallel with the axis O—O' of the adjuster 61 to be integral with the cylindrical tube 63 of the adjuster 61 and are spaced from one another at an equi-angular distance.

The radius r of the farthest portions (outer extreme portion) 64' of the plates (stays) 64 from the axis O—O' is identical to the radius r of the farthest portions 32' of the stays 32 shown in FIG. 6, mentioned above. Consequently, when the pattern controller 60 is loaded in the case 1, the axis of the pattern controller 60 can be coaxially aligned with the axis of the case 1.

Furthermore, it is possible to provide a plurality of (e.g., four) inclined stays 66 which are inclined at a predetermined angle $\alpha$ with respect to the axis C—C' of the stays 64 (or the center axis O—O' of the adjuster), as shown at a phantom line in FIG. 14. In this alternative, the axis C'—C'' of each stay 66 and the axis O—O' of the adjuster 41 lie in one imaginary plane, similar to the stays 64 mentioned above. The farthest portions (i.e., outer extreme portions) of the stays 66 from the axis O—O' are defined by points 66' of the stays 66 in the alternative. The distance r' between the points r' and the axis O—O' is predetermined depending on the rigidity and flexibility of the stays 66.

To insert the pattern controller 60 having therein the stays 66 into the case 1, the stays 66 are elastically gathered by a known "finger" of a wad guide which is a tool adapted to insert a fiber wad in the case. Consequently, when the pattern controller 60 has been inserted in the case 1, the stays 66 tend to be returned to the initial state due to the elastic restoring force thereof, so that the outer surfaces of the stays 66 can be press-fitted in the inner surface 38' of the cylinder of the wad 9A. Preferably, the front ends 66A of the stays 66 are chamfered to facilitate the insertion thereof into the cylinder of the wad.

The basic function of the improved pattern controller 60 is the same as that of the first embodiment, but since the width w (FIG. 15) of the stays 64 is longer than the width t (FIG. 7) of the stays 32 of the first embodiment corresponding thereto, the shotpellets held or surrounded by the pattern controller 60 do not tend to be partly forced out in the radial directions immediately after the pattern controller 60 is expelled from the muzzle, thus resulting in a higher pattern percentage, in the embodiment illustrated in FIGS. 14 and 15, than the pattern controller 30.

The pattern controller 30, 30A or 60 discussed above can be advantageously used with a skeet choke barrel or cylinder bore barrel. Taking into account the possibility that some users may load and shoot a shotshell having the pattern controller 30, 30A or 60 incorporated therein, in and from a choked barrel, which is however not recommendable, it is possible to provide axially extending grooves 65 on the outer peripheral surface of the adjuster 61 to prevent a production of an excess stress in the choke portion.

A second embodiment of the present invention addressed to a scattering type of pattern controller 40 which can be advantageously used with a skeet choke barrel or a cylinder bore barrel will be discussed below with reference to FIGS. 10 and 11.

Figure 10:
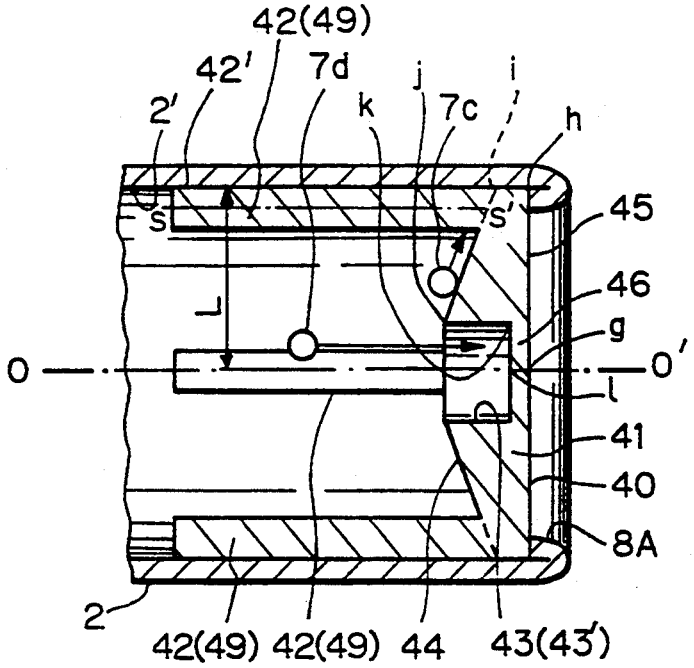
FIG. 10 is a side view of a pattern controller sectioned along a center axis X-Y shown in FIG. 11, according to a second embodiment of the present invention.

In FIG. 10 in which the same wad 9 as that shown in FIG. 1 is used, the shotpellets 7 are directly loaded in the cylindrical hull 2 of the case 1, and thereafter, the pattern controller 40 is fitted in the case 1 in the similar way to the first embodiment. After that, the open end of the cylindrical hull 2 is curled inward to form a crimp 8A so as to seal the case 1. No shotpellet is shown in FIG. 10 for clarity only. FIG. 11 is a rear view of the pattern controller 40 shown in FIG. 10, and FIG. 10 is a cross-sectional view taken along the line X-Y in FIG. 11, respectively.

The pattern controller 40 is made of the same material as that of the pattern controller 30 of the first embodiment and is comprised of an adjuster 41 and a support 49 coaxial thereto and integral therewith. The support 49 includes a plurality of (e.g., four) independent stays 42. The adjuster 41 is made of a solid which can be conceived as generated by revolving a closed shape, defined by straight lines connecting predetermined points g→h→i→j→k→l→g, about the axis O—O'. The line connecting the points l and g is on the axis O—O'. A plurality of stays 42 (4 stays in the illustrated embodiment) are each made of a circular rod integrally extending from the adjuster 41 in parallel with the axis O—O' in a symmetrical arrangement with respect to the axis O—O', so that the center axis S—S' of each stay 42 and the axis O—O' of the adjuster 41 lie in one imaginary plane. The adjuster 41 is provided with a flat front face 45 and a truncated conical guide face 44 whose diameter increases towards the front end thereof. The adjuster 41 is also provided on the central portion thereof with an axial circular blind hole 43 with a bottom 46. The bottom 46 is made of a thin film whose thickness corresponds to the axial length of the line connecting the points l and g. The diameter D of the adjuster 41 is identical to that in the first embodiment. Furthermore, the distance L between the farthest portions (outer extreme portions defined by lines in the embodiment illustrated in FIGS. 10 and 11) 42' of the stays 42 from the axis O—O' of the support 49 and the axis O—O' is equal to one-half the diameter D of the adjuster 41 and is larger than the radius r in the first embodiment shown in FIGS. 6 and 8. Consequently, similarly to the first embodiment, the pattern controller 40 can be snugly loaded in the case 1 while maintaining the correct posture (axial alignment with the axis O—O' of the case 1). Note that the shotpellets 7 are charged also in the blind hole 43.

The pattern controller 40 of the second embodiment operates as follows.

Upon ignition of the powder 4, the charged shotpellets 7 tend to be pushed forward by gas pressure, but no movement of the pattern controller 40 takes place because the front face 45 thereof is engaged by the crimp 8A of the case 1. At the same time, the shotpellets 7 charged in the blind hole 43 are pushed by the group of shotpellets D located behind the same, and accordingly, the bottom 46 of the blind hole 43 in the form of a thin film is pushed forward and expanded. Consequently, the stress is concentrated onto the circular corner portion k of the blind hole 43 at the bottom 46 thereof, so that the bottom 46 is broken and separated from the adjuster 41 along the circular corner portion k. As a result, the broken bottom 46 is scattered within the barrel bore. This results in an automatic formation of a through hole 43' which has been closed by the bottom 46. Thereafter, when the crimp 8A is straightened out by the increased gas pressure, the shot column which is covered at the front portion thereof, by the adjuster 41, and at the outer peripheral portion thereof, by the stays 42, respectively, passes through the barrel bore and is expelled from the muzzle 11. The pattern controller 40 whose front face 45 is flat receives the relative wind and is, accordingly, strongly braked. The shotpellets coming into contact with the guide face 44 of the pattern controller 40, e.g., the shotpellet **7*c*, are pushed by the large inertia of a large number of shotpellets, i.e., a group of shotpellets C, located behind the pellet 7*c*, and are moved in the radial direction along the inclined guide face 44, as indicated at arrows in FIGS. 10 and 11. Although the stays 42 slightly resist the movement of the shotpellet 7*c*, all the shotpellets of the pellet group C are separated outward from the circumferential edge of the adjuster 41** within an extremely short space of time, since other resistance is negligibly small. Thus, a substantial part of the shotpellets flies having a distribution in which the shotpellets are uniformly spread around the axis O—O'.

As can be understood from the above discussion, since a large velocity component in the radial direction is applied to each shotpellet 7, as indicated at V in FIG. 11, the shotpellets are scattered immediately after being expelled from the muzzle 11. Furthermore, since the shotpellets 7 are separated outward from the adjuster 41 during the flight of the shot column within an extremely short range, a (circular) pattern which is extremely larger than that of the conventional shotshell can be obtained at a predetermined shooting range.

The shotpellets behind the through hole 43', e.g., the shotpellet **7*d*, are pushed by the pellet group D, located behind the same to be advanced in the axial direction indicated by an arrow in FIG. 10, so that the shotpellet 7*d* passes through the through hole 43' and is expelled from the pattern controller 40. Namely, little scattering of the shotpellets occur, and the shotpellets discharged from the pattern controller 40 fly substantially in the expelling direction (axial direction). Consequently, a substantial part of the shotpellets 7 remain in the center of the pattern or the vicinity thereof, and accordingly, no doughnut-shaped pattern in which the density of shot at the center portion of the pattern is reduced is produced at a predetermined shooting range. Namely, in the second embodiment shown in FIGS. 10 and 11, since the shotpellets 7 which are introduced onto the inclined guide face 44 and other shotpellets 7 which pass through the through hole 43' fly in different directions, a shotshell having a large, uniformly distributed pattern can be obtained by appropriately setting the inclination angle of the guide face 44 and the diameter of the blind hole 43**.

Alternatively, it is possible to provide a modified pattern controller (not shown) in which the blind hole 43 of the adjuster 41 in the second embodiment is replaced with a through hole 43' discussed above, whose radius is equal to the axial length of the straight line connecting the points l and k. In this modified pattern controller, a thin cardboard wad commercially available on the market can be used. Namely, the thin cardboard wad is interposed between the front face 45 of the adjuster 41 and the crimp 8A and is curled together with the crimp 8A to seal the shotpellets 7 within the through hole 43'. Other structures and the operation of the modified pattern controller are the same as those in the second embodiment mentioned above.

Figure 12:
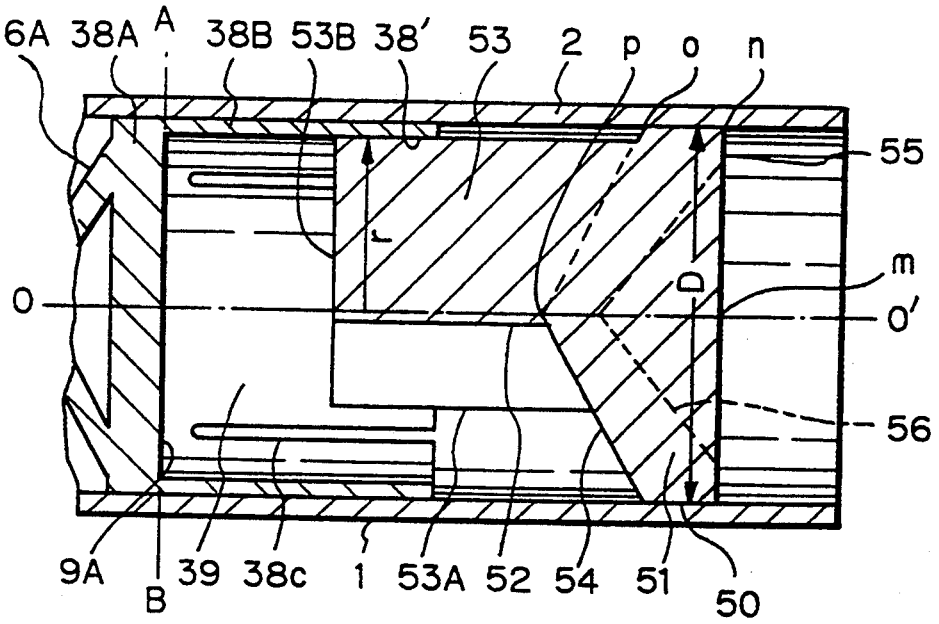
FIG. 12 is a partial sectional view of main components of a shotshell having a pattern controller incorporated therein, according to a third embodiment of the present invention.
Figure 13:
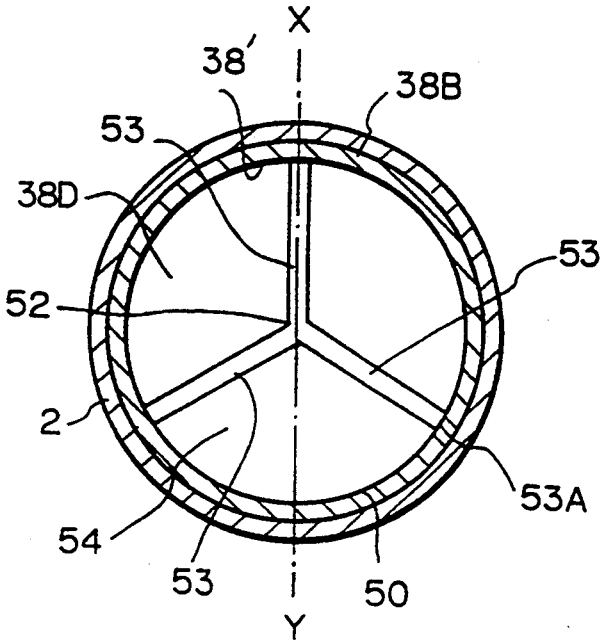
FIG. 13 is a sectional view taken along the line A-B in FIG. 12.

FIGS. 12 and 13 show a third embodiment of the present invention, applied to an ultra scattering type of pattern controller 50 which can be advantageously used with a skeet choke barrel or a cylinder bore barrel.

FIG. 12 shows a sectional view of main components contained in the case 1, taken along the axis X-Y in FIG. 13. In FIG. 12, the powder 4, the wad 9A, and the shot are charged in the case 1 in this order, and thereafter the pattern controller 50 is loaded in the case 1. Note that in FIG. 12, the crimp 8A (or crimp 8 in FIG. 8) shown in FIG. 10 is not yet curled and no shotpellets 7 are shown for clarity. FIG. 13 is a rear sectional view taken along the line A-B in FIG. 12. The wad 9A itself is identical to the wad in the first embodiment.

The pattern controller 50 which is made of the same material as the pattern controller of the first embodiment is provided, integrally therewith, with an adjuster 51 and a support 52. The adjuster 51 is made of a solid which may be conceived as generated by revolving a closed contour defined by straight lines connecting predetermined points m, n, o, p (m→n→o→p→m) about the axis O—O'. The adjuster 51 is provided with a flat front face 55 and a conical guide face 54 whose apex is located on the rear end side of the pattern controller 50.

The support 52 is provided with a plurality of stays 53 (e.g., 3 plates in FIGS. 12 and 13) which radially extend from the center axis thereof in an equiangular arrangement, with respect to the axis O—O'. The stays 53 define, at the farthest portions (outer extreme portions defined by peripheral surfaces 53A) thereof from the axis O—O', parallel with the latter, 53A thereof, an imaginary circle having a center located on the axis O—O'. Rear surfaces 53B of the plates 53 are normal to the axis O—O'. The support 52 comprised of the stays 53 integral with each other at the axis (center) thereof is integrally formed with the conical guide surface 54 of the adjuster 51.

Since the diameter D (FIG. 13) of the adjuster 51 and the radius r (FIG. 12) of the imaginary circle defined by the farthest portions 53A of the stays 53 which constitute the support 52 are identical to those of the pattern controller 30 in the first embodiment, the pattern controller 50 can be snugly fitted in the case 1 while maintaining the correct posture thereof, similarly to the first embodiment. When the pattern controller 50 is inserted in the case 1, the shotpellets within the cylindrical bore 38D of the wad 9A surround the plate 53 of the support 52. Finally, the open end of the case 1 is curled to form the crimp 8A, similarly to the arrangement shown in FIG. 10. It is possible to provide a conical recess 56, as shown by a phantom line in FIG. 12, on the center portion of the front face of the adjuster 51 to thereby form a fold crimp 8, as shown in FIG. 8.

It should be appreciated that the 'integral' structure referred to in the three embodiments discussed above includes a rigid connection of two elements, usually by an injection molding, as well as for example, by an adhesive, welding, press fit, or securing means such as a screw or a bolt, etc. Furthermore, it is possible to modify the combination of the adjuster and support of the pattern controller. Namely, for example, it is possible to combine the pattern controller 30 and the support 49.

There are two types of wads, one (e.g., wad 9 in FIG. 1) having no cylinder, and one (e.g., wad 9A in FIGS. 8 or 12) having a cylinder (cylinder 38B). It is possible to optionally combine the support (39, 49, or 52) in which the distance between the farthest portion (32', 42', or 53A) of the stays (32, 42, or 53) and the axis O—O' is set to be identical to "L" for the former wad (having no cylinder) and "r" for the latter wad (having the cylinder), and the adjuster (31, 41, or 51) in the above mentioned embodiments.

The operation of the third embodiment shown in FIGS. 12 and 13 is similar to the second embodiment shown in FIGS. 10 and 11. Namely, the shotpellets behind the adjuster 51 are moved and scattered in the radial directions along the inclined guide face 54. In the third embodiment, unlike the pattern controller 40 of the second embodiment, all the shotpellets move in the radial directions due to an absence of the blind hole 43, and the speed is higher than that in the second embodiment due to an absence of an obstacle member, such as the stays 42, which disturbs the movement of the shotpellets, in the vicinity of the outer peripheral portion of the guide face 54. Consequently, a wider spread (more opened) pattern than that of the pattern controller 40 of the second embodiment can be obtained in the third embodiment, and accordingly, the shotshell of the third embodiment can be more advantageously used, particularly for a short range shooting within ten yards, such as a skeet No. 8 shooting station.

Other advantages of the present invention are summarized as follows:

1. If the pattern controller 30 of the first embodiment is loaded with conventional steel shotpellets, a concentrated pattern can be realized even by a shotgun having a skeet choke or cylinder bore barrel, without using a shotgun having a great degree of choke. If a shotshell having steel shotpellets is loaded in a conventional shotgun having a choked barrel, the vicinity of the choke of the choked barrel can be damaged by the steel shotpellets when the latter is fired from the choked barrel.

2. If a scattering pattern of shotshell according to the second embodiment of the present invention, a conventional regular shotshell, and a concentration type of shotshell according to the first embodiment of the invention are loaded, in order, in a repeater, such as an auto-loader, the chances of hitting game which flushes at a close distance can be increased.

3. The simplicity of the pattern controller of the present invention simplifies the injection molding of the plastics of which the pattern controller is made and lowers the manufacturing cost thereof.

I claim:

1. A pattern controller for a shotshell including a case which is comprised of a metal head and a cylindrical hull connected thereto and defining a cylindrical bore, and a primer, said case being provided therein with powder, a wad, and shotpellets successively charged therein in this order, said cylindrical hull being deformed inward to form a crimp at an open end thereof to thereby complete the shotshell, wherein the pattern controller provided between the shotpellets and said crimp comprises an adjuster and a support coaxial thereto, said adjuster having a substantially circular periphery for snugly fitting in the cylindrical hull of the case, said adjuster being provided with pattern controlling means generated by revolving a predetermined shape about an axis of the pattern controller, said pattern controlling means being comprised of a guide face which is provided with at least one inclined surface opposed to the shotpellets to move the shotpellets in a lateral direction, and center hole means through which at least some of the shotpellets pass in the axial direction, said support being provided with a plurality of stays which integrally project from the guide face, each of said stays having a center axis which lies in the same imaginary plane as the center axis of the adjuster, said stays being separate from one another and located at an equiangular distance in a symmetrical arrangement with respect to the center axis of the adjuster, said stays being provided with outer extreme portions which are spaced from the center axis of the adjuster, said pattern controller being elastically rigid to substantially uniformly straighten out said crimp, while maintaining the shape and posture of the pattern controller when the latter has been loaded between the shotpellets and the crimp.

2. A pattern controller according to claim 1, wherein the guide face has a diameter which decreases towards the central hole means.

3. A pattern controller according to claim 1, wherein the guide face has a diameter which increases away from the stays.

4. A pattern controller according to claim 1, wherein said central means is a through hole.

5. A pattern controller according to claim 1, wherein said central hole is a blind hole with a bottom breakable by the shotpellets on ignition of the powder.

* * * * *